US006681419B1

(12) United States Patent
Page

(10) Patent No.: US 6,681,419 B1
(45) Date of Patent: Jan. 27, 2004

(54) FOREHEAD SUPPORT APPARATUS

(76) Inventor: Eric D. Page, 3612 Bali Dr., Sarasota, FL (US) 34232

( * ) Notice: Subject to any disclaimer, the term of this patent is extended or adjusted under 35 U.S.C. 154(b) by 0 days.

(21) Appl. No.: 10/294,321

(22) Filed: Nov. 14, 2002

(51) Int. Cl.[7] ..... A47K 3/22
(52) U.S. Cl. ..... 4/661; 4/301
(58) Field of Search ..... 4/661, 301, 310, 4/575.1, 523, 611; 5/652, 655.9; 378/208

(56) References Cited

U.S. PATENT DOCUMENTS 6,061,842 A 5/2000 Randolph, Sr.
6,154,903 A 12/2000 Wai-Chung

*Primary Examiner*—Gene Mancene
*Assistant Examiner*—Azadeh Kokabi
(74) *Attorney, Agent, or Firm*—Charles J. Prescott

(57) ABSTRACT

A forehead support apparatus for resting a standing users forehead against a wall above a bathroom commode or urinal or beneath a showerhead. The apparatus includes a mounting member adapted for attachment to an upright bathroom wall either above the commode or urinal or below the showerhead. A compressible head support member is attached to and extends from the wall and said mounting member. The head support defines an elastically deformable or resilient forehead support surface which is spaced above the floor and from the wall a distance sufficient for the user to lean his forehead thereagainst and be supported while using the commode or urinal.

10 Claims, 6 Drawing Sheets

FOREHEAD SUPPORT APPARATUS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

This invention relates generally to compressible body support members, and more particularly to a urinal headrest against which a user may place his forehead and restfully lean thereagainst while using a urinal or commode.

Those who are tired and weary and find themselves in need of using a urinal or a commode may find the time required to stand in an upright position excessively long and burdensome. At present, the only option for in any way relieving the stress and tension of a tired or depleted body is to simply place the forehead against the wall onto which the urinal or commode is positioned or attached.

A number of prior U.S. patents are known to applicant which are intended to provide some support for a portion of the torso or limb of a user as follows:

U.S. Pat. No. 6,154,903 to Wai-Chung

U.S. Pat. No. 4,560,201 to Scott

U.S. Pat. No. 5,632,050 to Zajas et al.

However, none of these devices in any way provide a teaching for use thereof for supportive leaning comfort as above described to someone using a urinal or commode.

One device disclosed in U.S. Pat. No. 6,061,842 invented by Randolph does disclose a hand support apparatus over a commode or urinal. This device, which is swively adjustable and lockable in various angular orientations with respect to the wall, provides a hand support position for the dirty hands of someone wanting to use a commode or urinal. In one embodiment, disposable sheets are provided so that a subsequent user will have a clean surface against which to place one of another set of dirty hands.

The present invention provides an answer to those users of urinals and commodes which find the duration of the event onerous, possibly made worse by a tired or somewhat incapacitated physical condition. Such a user of a urinal or commode will simply place his forehead against the compressible surface provided by the apparatus to effect a more comfortable inwardly leaning orientation with respect to the commode or urinal.

BRIEF SUMMARY OF THE INVENTION

This invention is directed to a forehead support apparatus for resting a standing user's forehead above a bathroom commode or urinal. The apparatus includes a mounting member adapted for attachment to an upright bathroom wall above the commode or urinal. A compressible head support member is attached to and extends from the wall and said mounting member. The head support defines an elastically deformable or resilient forehead support surface which is spaced above the floor and horizontally from the wall a distance sufficient for the user to lean his forehead thereagainst and be supported while using the commode or urinal. One embodiment is also adapted for attachment beneath a showerhead of a shower stall.

It is therefore an object of this invention to provide a forehead support apparatus which is specifically structured for attachment to a wall surface above a urinal or commode for user comfort.

Yet another object of this invention is to provide a comfortable means for providing leaning rest to someone who may be weary, tired or partially impaired and requires a more stable and comfortable leaning posture while occupying both hands while using a urinal or commode.

Still another object of this invention is to provide an elongated forehead support apparatus which spans across a plurality of spaced apart urinals or commodes as in a public lavatory setting for accommodating one or more users of the urinals or commodes adjacent one another.

It is yet another object of this invention to provide a comfortable means for leaning one's head against a rest attached to a shower wall beneath a shower head of a shower stall.

BRIEF DESCRIPTION OF THE SEVERAL VIEWS OF THE DRAWING(S)

DETAILED DESCRIPTION OF THE INVENTION

Figure 1:
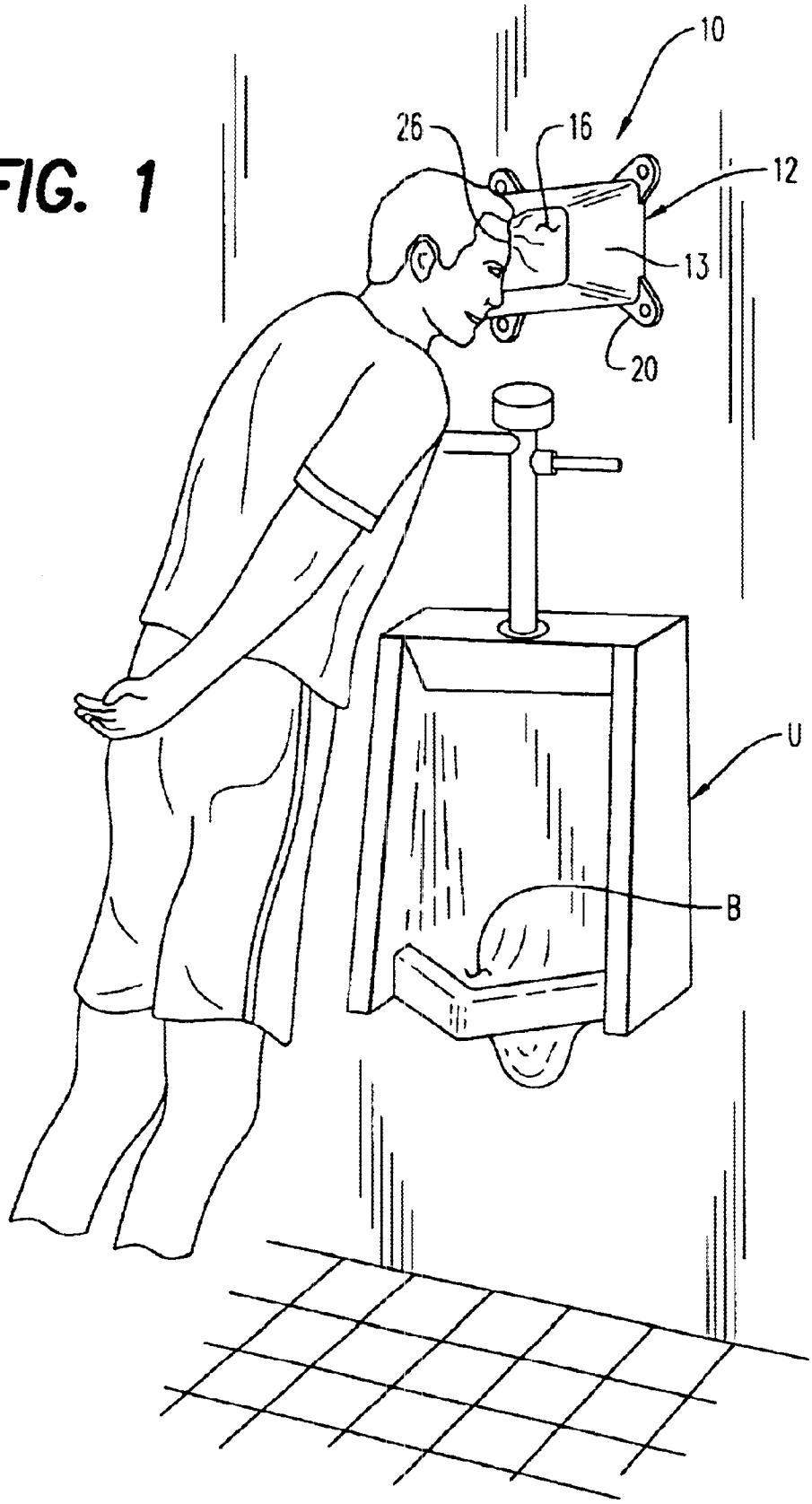
FIG. 1 is a perspective view of the invention in use associated with a urinal.

Referring now to the drawings, the preferred embodiment of the invention is shown generally at numeral 10 in FIGS. 1 to 4. This embodiment 10 includes a compressible forehead support member 12 and at least one mounting member or lug 20 which provides one means for attaching the back surface 18 of the apparatus 10 to the wall surface above a urinal U. Other attaching means may be substituted.

Figure 2:
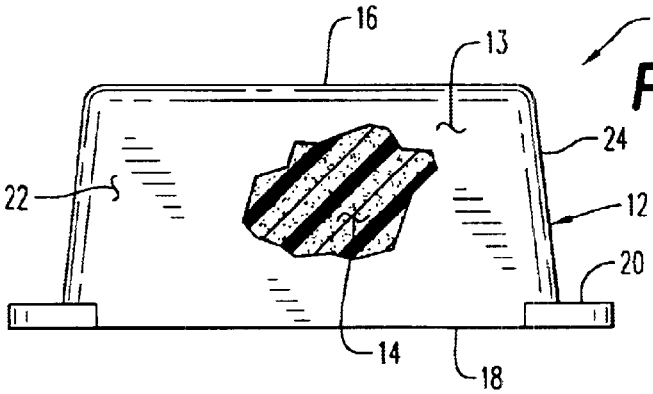
FIG. 2 is a broken top plan view of the invention of FIG. 1.
Figure 3:
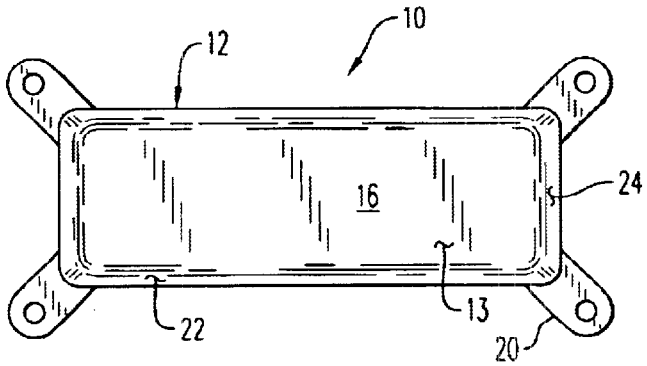
FIG. 3 is a frontal elevation view of the invention of FIG. 1.
Figure 4:
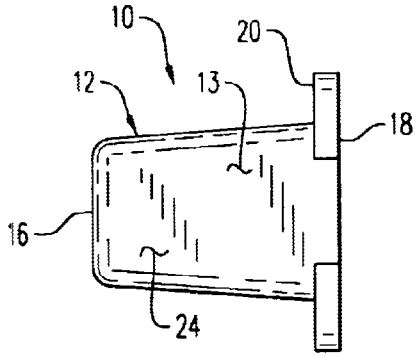
FIG. 4 is a side elevation view of the invention of FIG. 1.

As best seen in FIG. 3, a plurality of these mounting members or lugs 20 are provided, one extending diagonally from each corner of the head support member 12. As seen in FIG. 2, the forehead support member 12 is formed of an inner compressible foam material 14 over which a layer of flexible vinyl, fabric or naugahyde material 13 has been formingly disposed and attached as upholstery.

When the apparatus 10 is attached above the urinal as shown in FIG. 1 at a distance above the floor a distance generally equal to the average height of the forehead of a male, a user may then position his forehead in contact with the forehead support surface 16 at 26. The elasticity of the inner foam material 14 and the outer covering material 13 of choice, combine to provide the comforting resilient indentation shown at 26 in FIG. 1 so that the user may comfortably lean thereagainst while using the urinal U and its basin B.

Figure 5:
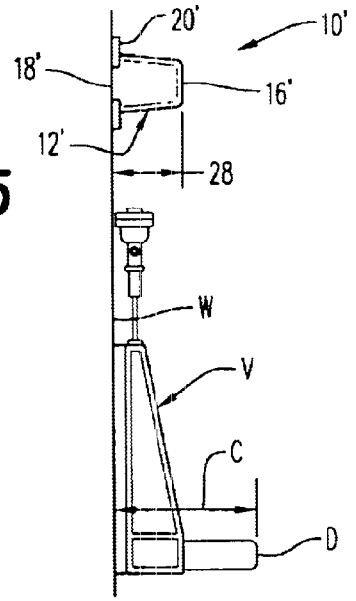
FIG. 5 is a side elevation schematic view of a variation of the invention of FIG. 1 attached to a wall above a urinal.

Referring now to FIG. 5, another conventional urinal V is there shown mounted against the upright wall surface W and having a bowl D defining the lower urinal structure. The apparatus 10' is similar to that previously described except that it is shown having substantially orthogonal side and end walls rather than the tapered side walls 22 and 24 of FIGS. 1 to 4. In this embodiment 10', the forehead support member 12' is again attached by the back surface 18' against the wall W by mounting ears or lugs 20'. Resilient support surface 16' is thus positioned vertically above the floor a height of approximately that of the average male or child user of the urinal V. This height information is derivable from current demographic information available elsewhere.

Importantly, the horizontal distance 28 of the forehead support surface 16' from the wall W provides the level of leaning comfort without exaggerated leaning or tipping of the user with respect to the wall or the urinal V. This distance 28 is typically in proportion to the lateral width C of the bowl D and is in the range of 5" to 15", depending on whether the urinal V is for adults or children and the outward length C of the bowl D. Typically a dimensional relationship between 28 and C is in the range of 1:3 to 1:2.

Figure 6:
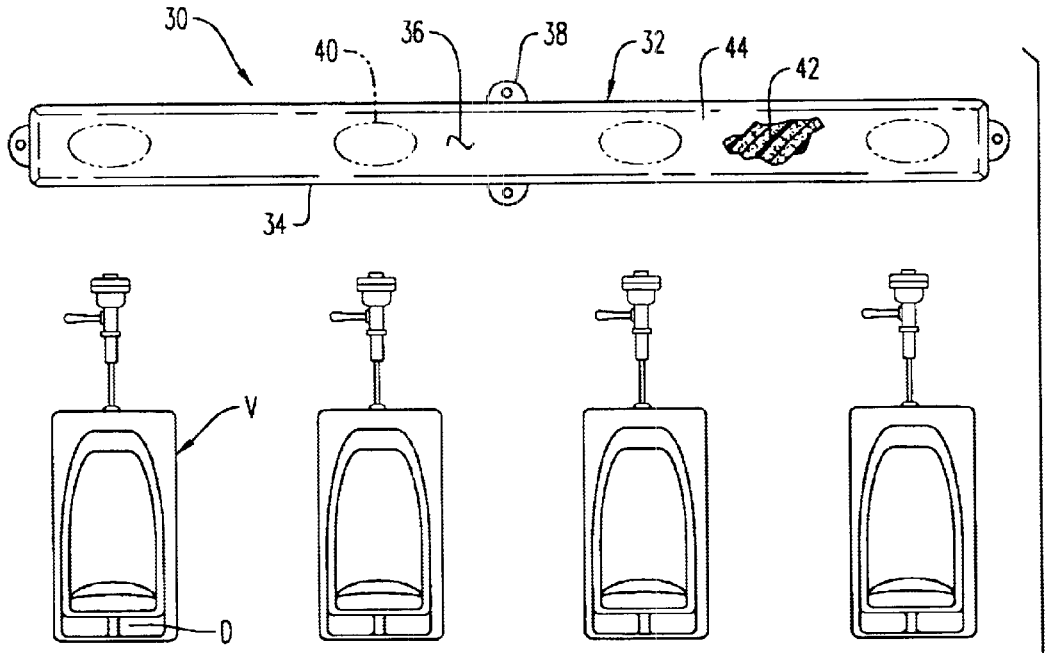
FIG. 6 is a front elevation view of an elongated embodiment of the invention which spans a plurality of wall-mounted urinals.

Referring now to FIG. 6, yet another embodiment of the invention is there shown generally at numeral 30 and is provided with an elongated forehead support member 32 having an elongated horizontal length along the wall surface which will span a plurality of spaced urinals V. Urinal spacing is immaterial so long as the elongated forehead support member 32 having a compressible surface 36 is of sufficient length so that a user of any of the urinals V will be provided with a resilient forehead support surface shown in phantom at 40.

Again, lugs or mounting members 38 provide a convenient means for attachment of the apparatus 30 mechanically to the wall, while the inner compressible foam structure 42 provides the desired resiliency of the forehead of the user thereagainst for added comfort. Again, note that all conventional attaching means to the wall is envisioned.

Figure 7:
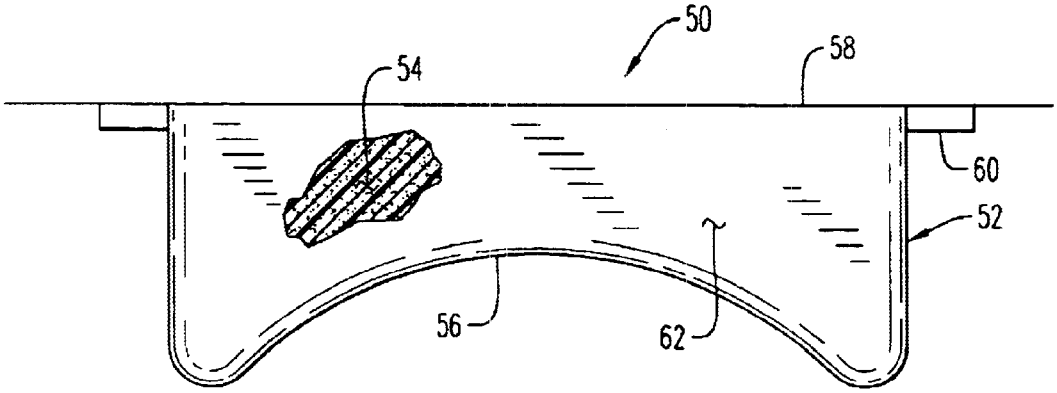
FIG. 7 is a top plan view of still another embodiment of the invention.

In FIG. 7, still another embodiment of the invention is thereshown generally at numeral 50 attached by mounting lugs or members 60 against an upright wall surface. The compressible foam material 54 is structured, in combination with the outer flexible layer of material 62 of the forehead support member 52 so as to provide an arcuately concaved forehead support surface 56 against which a user's forehead may be placed. This embodiment 50 thus provides not only for lateral stability while leaning thereagainst while using a urinal or commode, but also a more arcuately compliant surface for added forehead comfort for long stays at the urinal.

Figure 8:
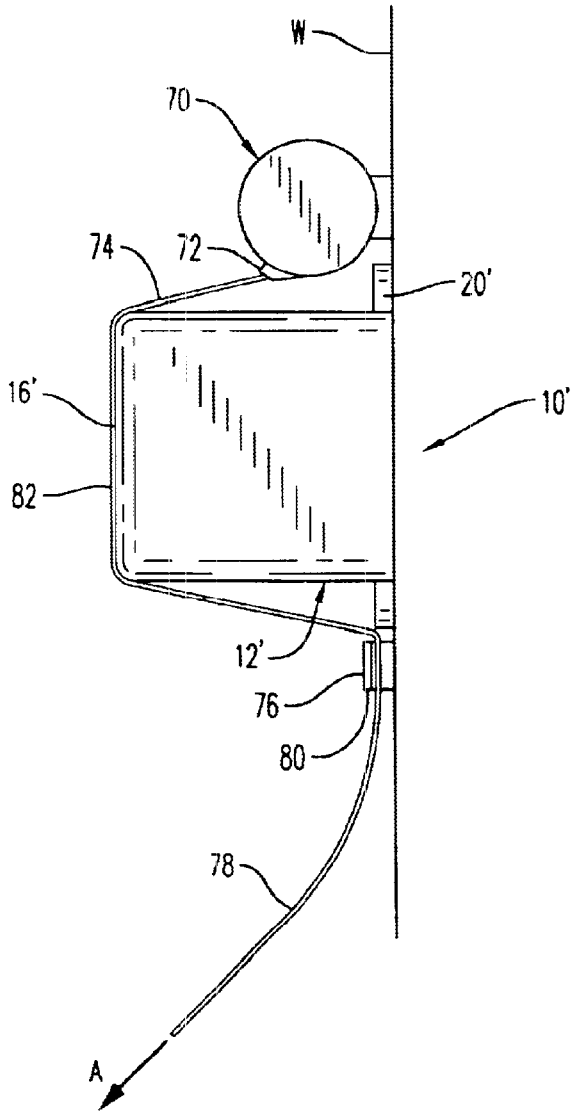
FIG. 8 is a broken side elevation schematic view of yet another embodiment of the invention.

In FIG. 8, this embodiment of the invention with respect to the apparatus itself is shown generally at 10' as described previously with respect to FIG. 5. The addition of a disposable paper dispenser 70 is also provided. The dispenser 70 is attached to the wall immediately adjacent the apparatus 10' such that a length or continuous web of disposable paper or tissue 74 which extends from an elongated slot 72 is provided. By pulling the disposable paper web 74 across the forehead support surface 16' at 82, and then feeding it through a cutting bar 76 having a cutting edge 80, the user may then pull a fresh section of the disposable paper web 74 downwardly in the direction of arrow A and then tear the soiled portion 78 away by the cutting edge 80. By this means of FIG. 8, each user may be provided with a fresh unsoiled disposable paper segment 82 against which he may place his forehead for sanitary support by the apparatus 10'.

Figure 9:
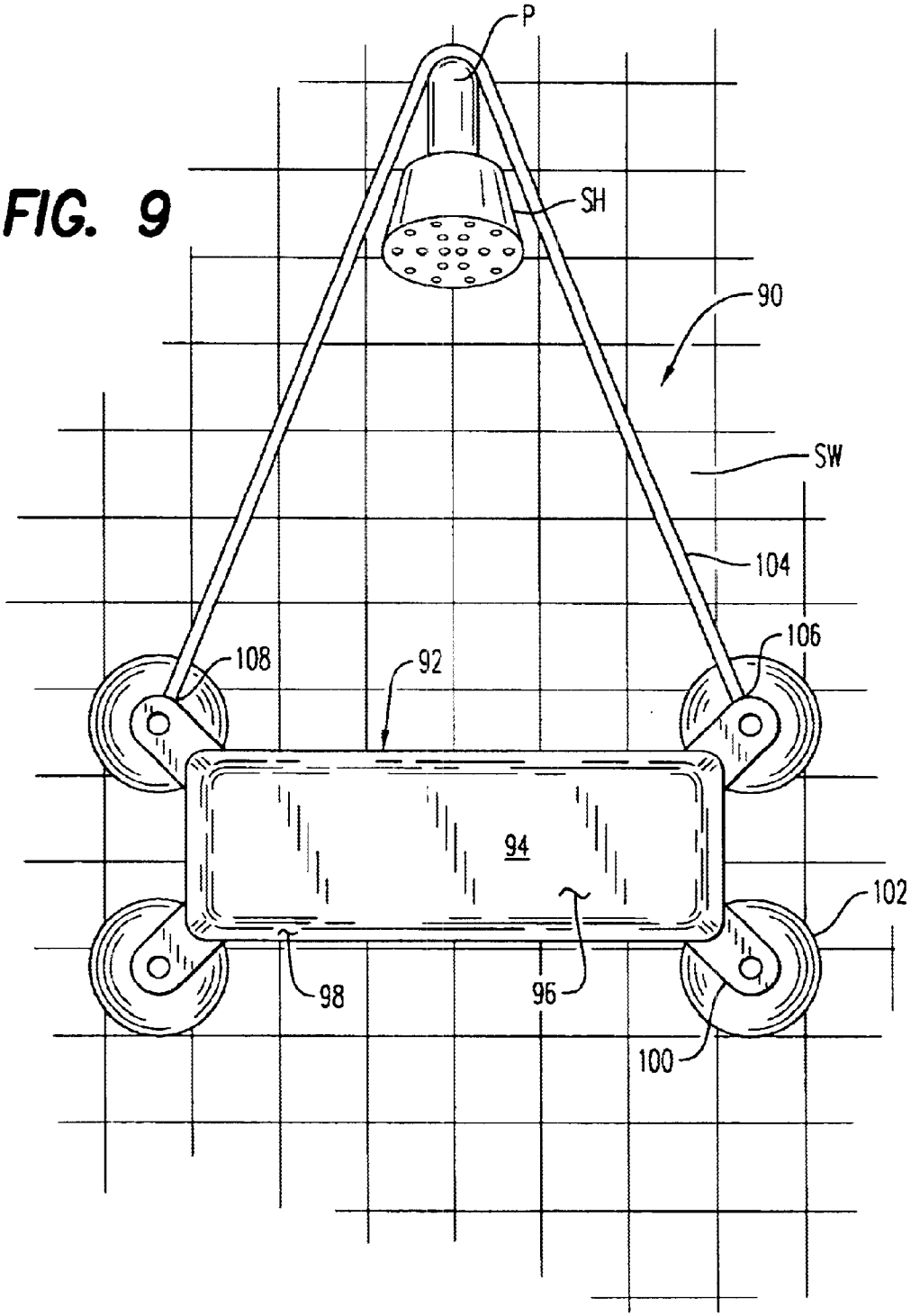
FIG. 9 is a front elevation view of another embodiment of the invention positioned against a shower wall.
Figure 10:
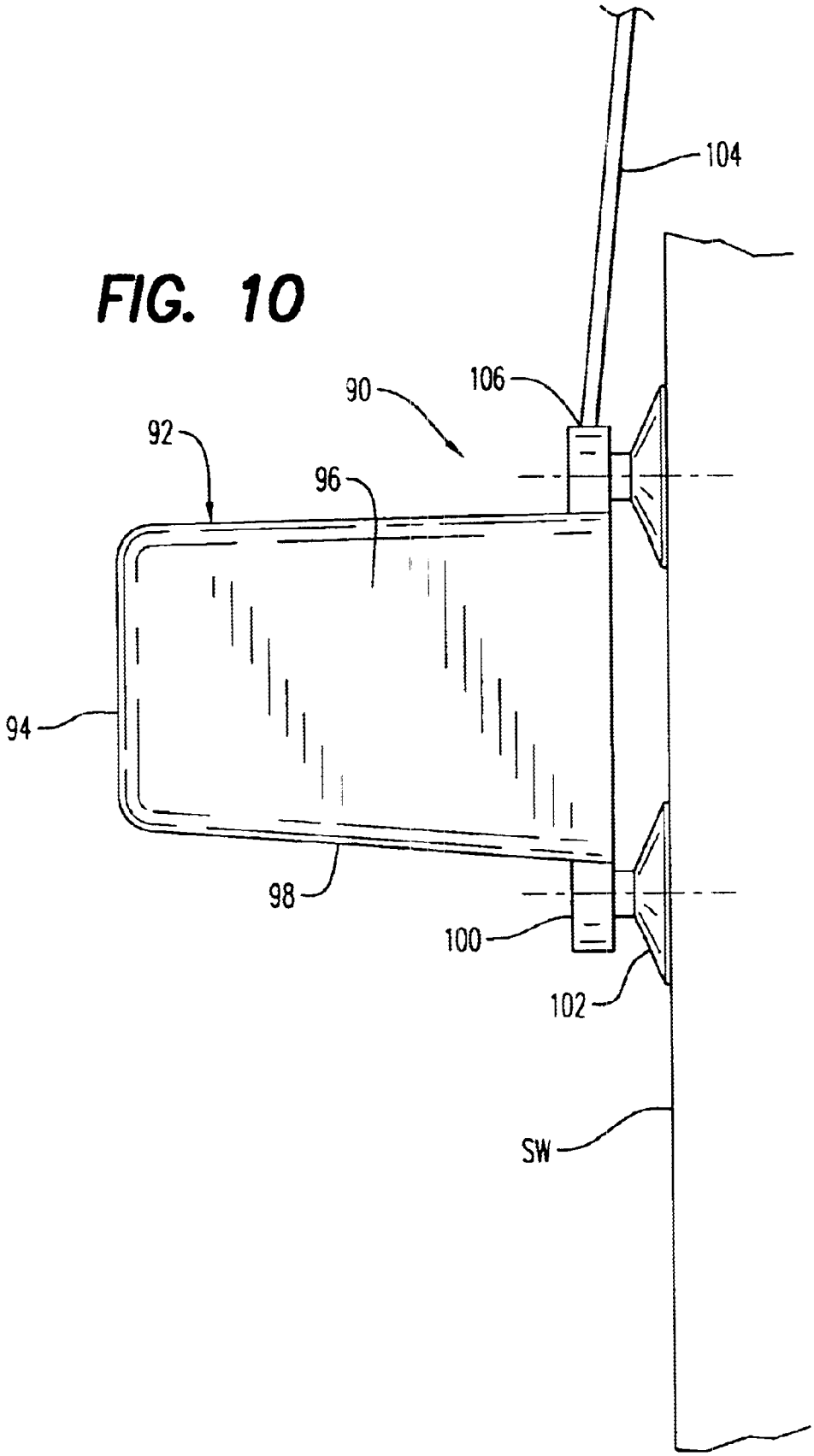
FIG. 10 is a side elevation view of FIG. 9.

Referring lastly to FIGS. 9 and 10, another embodiment of the invention is there shown generally at numeral 90 attached against an upright shower wall SW and positioned beneath a showerhead SH. This forehead support apparatus 90 is positioned at a height above the shower floor to allow the user in a standing position to rest the forehead thereagainst. This embodiment 90 includes a forehead support member 92 formed of inner compressible foam material 14 over which a waterproof layer of flexible material 96 has been disposed as previously described with respect to the embodiment of FIGS. 1 to 4. The side walls shown typically at 98 are tapered.

This embodiment 90 is attachable beneath the showerhead SH in one of two alternate or combined ways. The support member 92 may either hung by a flexible rope 104 attached at 106 and 108 to laterally extending mounting members or lugs 100 and wrapped over the pipe P or, alternately attached by suction cups 102 which are also connected to each of the mounting members or lugs 100.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A forehead support for resting a standing user's forehead above a wall mounted urinal comprising:

a mounting member adapted for substantially permanent attachment to an upright bathroom wall above the urinal;

a forehead support member attached to and extending from said mounting member;

said forehead support defining an elastically deformable or resilient forehead support surface which is spaced from the wall a distance sufficient for the user to lean his forehead thereagainst and be supported while using the commode or urinal.

2. A forehead support as set forth in claim 1, wherein:

said forehead support member has generally rectangular surfaces, said forehead support surface being horizontally elongated.

3. A forehead support as set forth in claim 1, wherein:

said forehead support surface is concaved when viewed from above providing enhanced lateral stability and greater forehead contact area for comfort.

4. A forehead support as set forth in claim 1, further comprising:

a rolled paper dispenser device attached to the wall immediately adjacent to said forehead support for dispensing and holding a fresh sheet segment of disposable paper against said forehead support surface by the user.

5. A forehead support for resting a standing user's forehead above a wall mounted urinal comprising:

a mounting member having mounting lugs which are adapted for permanent attachment against an upright bathroom wall above the urinal;

a resilient forehead support member attached to and extending from said mounting member;

said forehead support defining a resilient forehead support surface which is spaced from the wall a distance sufficient for the user to lean the forehead thereagainst and be supported in a slightly leaning body orientation while using the urinal.

6. A forehead support as set forth in claim 5, wherein:

said forehead support member has generally rectangular surfaces, said forehead support surface being horizontally elongated.

7. A forehead support as set forth in claim 5, wherein:

said forehead support surface is concaved when viewed from above providing enhanced lateral stability and greater forehead contact area for comfort.

8. A forehead support as set forth in claim 7, further comprising:

a rolled paper dispenser device attached to the wall immediately adjacent to said forehead support for dispensing and holding a fresh sheet segment of disposable paper against said forehead support surface by the user.

9. A forehead support for resting one or more standing users' foreheads above a plurality of spaced apart wall mounted urinals comprising:

an elongated mounting member adapted for permanent attachment to an upright bathroom wall of a length sufficient to extend along and above all of the urinals;

a resilient forehead support member attached to, coextensive with, and extending outwardly from said mounting member and the wall;

said forehead support defining a plurality of resilient forehead support surfaces which are spaced from the wall a distance sufficient for each of the users to lean the forehead thereagainst and be supported in a slightly inclined position while using the urinal.

10. A forehead support for resting a standing user's forehead above a wall mounted urinal or against a shower wall beneath a shower head comprising:

a mounting member adapted for attachment to an upright bathroom wall above the urinal or beneath the shower head;

a compressible forehead support member attached to and extending from said mounting member;

said forehead support defining an elastically deformable or resilient forehead support surface which is spaced from the wall a distance sufficient for the user to lean his forehead thereagainst and be supported while using the urinal or showering.

* * * * *